US005885434A

United States Patent [19]

Suda et al.

[11] Patent Number: 5,885,434

[45] Date of Patent: Mar. 23, 1999

[54] METHOD AND APPARATUS FOR PERFORMING FINE WORKING

[75] Inventors: Masayuki Suda; Toshihiko Sakuhara; Tatsuaki Ataka, all of Chiba, Japan

[73] Assignee: Seiko Instruments Inc., Japan

[21] Appl. No.: 829,840

[22] Filed: Apr. 1, 1997

[30] Foreign Application Priority Data

Apr. 2, 1996 [JP] Japan ..... 8-104581

[51] Int. Cl.[6] ..... C25D 21/12; C25D 17/00; C25F 3/00; C25F 7/00

[52] U.S. Cl. ..... 205/81; 205/645; 205/654; 205/686; 204/225; 204/231

[58] Field of Search ..... 205/645, 654, 205/686, 81, 137

[56] References Cited

U.S. PATENT DOCUMENTS

| | | | |
|---|---|---|---|
| 4,475,995 | 10/1984 | Ziegler et al. | 205/645 X |
| 4,541,909 | 9/1985 | Fromson | 205/645 X |
| 4,814,052 | 3/1989 | Konietzni et al. | 205/645 X |
| 5,308,974 | 5/1994 | Elings et al. | 250/234 |
| 5,630,932 | 5/1997 | Lindsay et al. | 205/645 |

OTHER PUBLICATIONS

Journal of the Electrochemical Society, vol. 140, No. 5, May 1, 1993, pp. 1281–1284, Claudia E. Bach, et al., "Effective Insulation of Scanning Tunneling Microscopy Tips for Electrochemical Studies Using an Electropainting Method".

Patent Abstract of Japan, vol. 018, No. 078 (P–1689), Feb. 8, 1994.

Patent Abstracts of Japan, vol. 018, No. 252 (E–1547), May 13, 1994.

*Primary Examiner*—Donald R. Valentine
*Attorney, Agent, or Firm*—Adams & Wilks

[57] ABSTRACT

A method for performing fine working of a material by electrochemical reaction comprises a two-step scanning operation in which a surface topography of the material is obtained during a first scan which is used to control the position of a probe during a second scan in which an electrochemical reaction is performed. During the first scan, an electrochemical cell is constructed with a four-electrode system, including the probe, a material to be worked, a reference electrode and a counter electrode. The potential of each of the probe and the material to be worked is set so that no electrochemical reaction occurs during the first scan. Data representative of the surface topography is stored and used to control the position of the probe during the second scan in which an electrochemical cell is constructed with a three-electrode system, including the probe, the material, and the reference electrode. The potential of the material with respect to the probe is set such that the electrochemical reaction occurs during the second scan, and the probe is maintained at a distance determined based on the stored topographical data.

20 Claims, 3 Drawing Sheets

METHOD AND APPARATUS FOR PERFORMING FINE WORKING

BACKGROUND OF THE INVENTION

The present invention relates to a method of performing fine working which is directed, in metal industries, electronic industries, etc., to performing fine working in a solution through an electrochemical reaction by the use of a probe having a fine tip.

As a method of performing working in a liquid through an electrochemical reaction by the use of a probe having a fine tip, there has heretofore been reported a method of performing working by the use of an electrochemical scan type tunnel microscope.

In a method of performing fine working which is directed to approaching a probe having a fine tip to the surface of a material to be worked and thereby performing fine working by utilizing an electrochemical reaction that occurs between the two, in order to enhance the working precision it is important to decrease the distance between the probe and the material to be worked and maintain this distance to be constant. If the distance between the probe and the material to be worked increases, the working area inconveniently widens. Also, if the distance between the probe and the material to be worked varies during the working operation, it is difficult to shape the worked configuration as predetermined. Since in order for the working precision may be on the order of sub-microns it is necessary for the distance between the forward end of the probe and the material to worked be also be at a level of sub-microns, it is difficult to control such a fine distance with the use of optical means. On account of this, if measurement is performed of the tunnel current that flows between the forward end of the probe and the material to be worked, it becomes possible to control such a fine distance with a high precision relatively easily. While the conventional method of performing fine working that uses an electrochemical scan type tunnel microscope is also arranged to make feedback control of the probe-to-specimen distance by the use of this tunnel current, it involves several problems.

First, there is pointed out the respect that when an electrochemical reaction is caused to occur between the probe and the material to be worked, a Faraday current (electrolytic current) flows between the two. It is difficult to determine whether the current that flows between the probe and the material to be worked is a tunnel current or Faraday current. Also, in the method using feedback control of the probe-to-working-material distance by the use of the tunnel current, there is the problem that when an electrochemical reaction occurs with the result that a Faraday current flows, the distance between the probe and the material to be worked inconveniently varies with the result that the worked configuration diverges from the predetermined configuration. In order to avoid the occurrence of this problem, there can be also considered the use of a method to make the feedback control ineffective at the time of performing the working operation and to fix the Z-axial position of the probe. However, there is a problem in that when working is continuously performed while the probe is being moved, since the distance between the material to be worked and the probe is very short, the probe inconveniently collides with the material to be worked due to the surface roughness thereof, surface inclinations thereof, etc. Also, in a case where the feedback control is performed with the use of a tunnel current, the distance between the material to be worked and the probe must be a magnitude of distance that enables the detection of the relevant tunnel current. Namely, the degree of freedom with which the relevant distance can be set is not high.

Also, since in the process of an electrochemical reaction the amount of reaction is proportionate to the value of the Faraday current, in order to adjust the amount of working it is important to control the Faraday current that flows between the probe and the material to be worked. In the conventional electrochemical scan type tunnel microscope, generally, the probe and the material to be worked operate respectively as working electrodes and an electrochemical cell is constructed with a four-electrode system that comprises these working electrodes and reference and counter electrodes added thereto. In the case of this construction, although the potential of each of the probe and the material to be worked can be independently set, the cell basically is constructed with a main purpose placed on controlling the electrochemical reactions that occur between the probe and counter electrode and between the material to be worked and counter electrode. This means that the cell construction is not made so as to control precisely the Faraday current between the probe and the material to be worked. For this reason, there arises also the problem that it is difficult to adjust the amount of working.

SUMMARY OF THE INVENTION

It is an object of the present invention to provide a method of performing fine working that is possible to maintain a fixed distance between a probe and a specimen with no Faraday-current effect.

It is another object of the present invention to provide a method of performing fine working in which it is possible to set the distance between the probe and the specimen to be at a large distance that disables the detection of the tunnel current, with the result that the degree of freedom for setting such distance is high.

It is a further object of the present invention to provide a method of performing fine working in which it is possible to control easily an amount of working by controlling the Faraday current.

On this account, in the method of performing fine working according to the present invention, in order to solve the above-mentioned problems, data representing the topgraphy, i.e., inclinations and surface roughness of the working region of the material to be worked with respect to which working is about to be performed is pre-stored in a memory device and, at an actual time of working, the Z-axial position of the probe is controlled according to the pre-stored data so that the distance between the probe and the material to be worked may be fixed. First, the electrochemical cell is constructed with a four-electrode system that comprises the probe, the material to be worked, a reference electrode and a counter electrode and then the potential of each of the probe and material to be worked is set to fall within a range of potentials that causes no electrochemical reaction to occur. Then the Z-axial position of the probe is controlled so that the tunnel current that flows between the material to be worked and the probe may be fixed. While moving the probe along a working line along which working is about to be performed, the Z-axial position of the probe is continuously stored to thereby store the irregularities and inclinations of the surface of the material to be worked. At this time, since the potential of each of the probe and material to be worked is set to be a level that falls within a range that causes no electrochemical reaction to occur, no Faraday current flows with the result that only the tunnel current alone can be accurately measured.

Next, the electrochemical cell is re-constructed as a three-electrode system that comprises the probe, the material to be worked and the reference electrode, whereby the probe is again moved, while controlling this time the Z-axial position thereof to be at the above-mentioned stored position or at a position that has been obtained by adding thereto a certain fixed offset, along the working line along which measurement has been made of the surface configuration of the material to be worked. Simultaneously with the re-measurement of the probe, a voltage is applied between the probe and the material to be worked to thereby cause the occurrence of an electrochemical reaction between the probe and the material to be worked. At this time, since the electrochemical cell is constructed with a three-electrode system and the distance between the probe and the material to be worked is kept fixed, it is possible to control easily the Faraday current that flows between the probe and the material to be worked. In addition, since at the working time there is no need to detect the tunnel current, the distance between the probe and the material to be worked can be freely set. For example, if it is desired to enlarge the working spot, it is possible to set the distance between the probe and the material to be worked to be at a value that is increased as the necessity arises.

DETAILED DESCRIPTION OF THE PREFERRED EMBODIMENTS

An embodiment of a method of performing fine working according to the present invention will now be explained with reference to the drawings.

Figure 1:
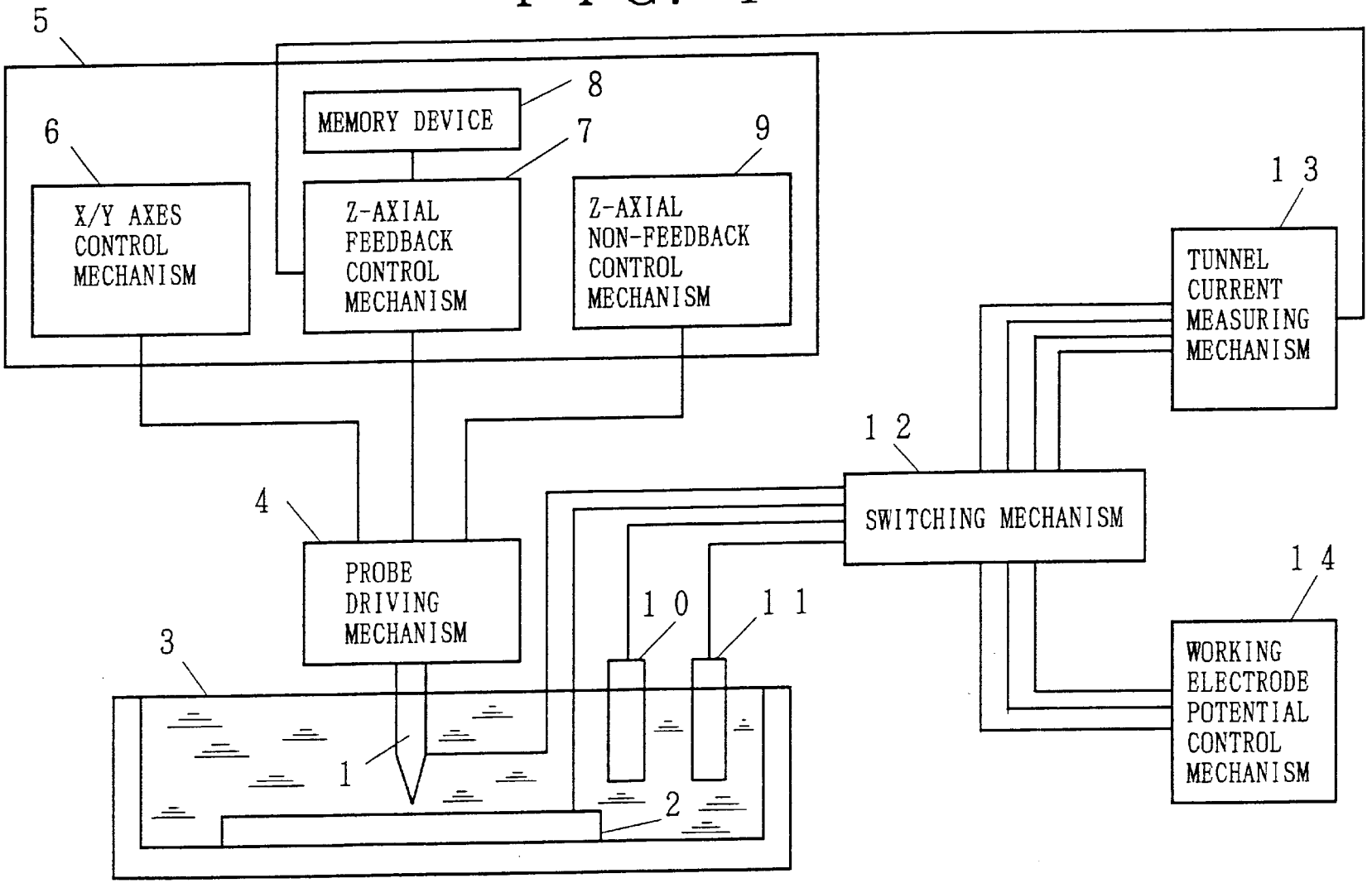
FIG. 1 is a block schematic diagram of an apparatus according to the present invention.

FIG. 1 is a view illustrating an example of an apparatus for performing fine working that has been constructed for the purpose of executing the method of performing fine working according to the present invention. A probe 1 and a material to be worked 2 are immersed in an electrolytic solution 3 and are disposed in such a manner as to oppose each other. The probe 1 is installed on a probe driving mechanism 4 that is movable with high precision in the X, Y and Z directions. While in this embodiment a mechanism that comprises a plurality of combined piezoelectric elements is used as the probe driving mechanism 4, such mechanism is not a constituent element that is indispensable for the method of performing fine working according to the present invention and this mechanism can be replaced by another mechanism that has a similar function. Further, the probe driving mechanism 4 is connected to a probe position control mechanism 5. The probe position control mechanism 5 comprises in the interior thereof an X/Y axes control mechanism 6 for controlling the horizontal position of the probe, a Z-axis feedback control mechanism 7 for controlling the Z-axial position of the probe 1 so that the tunnel current that flows between the probe 1 and the material to be worked 2 may be fixed, a memory device 8 which is connected to the Z-axis feedback control mechanism 7 and which can continuously record therein the variation in the Z-axial position of the probe 1 during the feedback control and from which the thus-recorded data can be again read out, and a Z-axis non-feedback control mechanism 9 for controlling the Z-axial position according to the data from the memory device 8. Also, within the electrolytic solution 3 there are installed a reference electrode 10 which in the electrochemical measurement serves as a reference for the electrode potential and an outer electrode 11, which in the electrochemical measurement serves as an electrode for applying a potential. The probe 1, material to be worked 2, reference electrode 10 and outer electrode 11 are connected through a switching mechanism 12 to one of a tunnel current measuring mechanism 13 that includes a measuring electrode potential control mechanism and a working electrode potential control mechanism 14. The signal from the tunnel current measuring mechanism 13 is input to the above-mentioned Z-axis feedback control mechanism 7. When the switching mechanism 12 has been operated to make a changeover to the tunnel current measuring mechanism 13, there is constructed the electrochemical cell with a four-electrode system wherein the probe 1 and material to be worked 2 operate respectively as the and working electrodes and outer electrode 11 operates as the counter electrode. On the other hand, when the switching mechanism 12 has been operated to make a changeover to the working electrode potential control mechanism 14, there is constructed the electrochemical cell with a three-electrode system wherein the probe 1 operates as the counter electrode and the material to be worked 2 operates as the working electrode.

Figure 2:
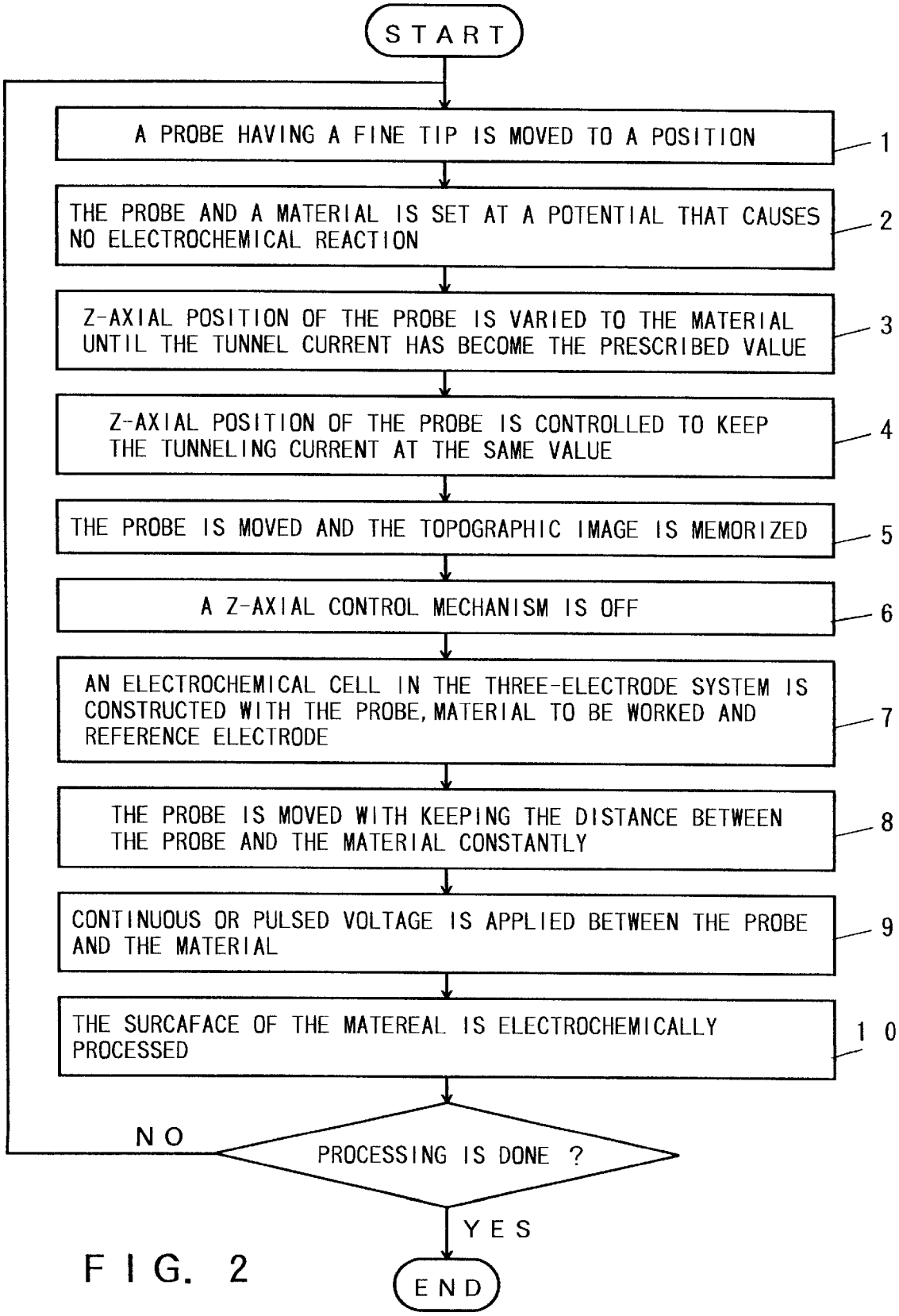
FIG. 2 is a flowchart of a method of performing fine working according to the present invention.

FIG. 2 is a flowchart of a preferred method of performing fine working according to the present invention. When performing working, first, the probe 1 is moved by the X/Y axes control mechanism 6 to the position at which the working of the material to be worked 2 is to be started. (step 1)

Next, the switching mechanism 12 is operated to make a changeover to the tunnel current measuring mechanism 13 and then the potential of each of the probe 1 and material to be worked 2 is set to be in a range of potentials that causes no electrochemical reaction to occur between the two. (step 2)

Then, the Z-axial position of the probe 1 is varied slowly to approach the probe 1 to the material to be worked 2. (step 3) At this time, while the tunnel current that flows between the probe 1 and the material to be worked 2 is being measured by the use of the tunnel current measuring mechanism 13, approach is made of the probe 1 to the material to be worked 2 until the value of the tunnel current becomes a value that is prescribed.

After the value of the tunnel current has become the prescribed value, the Z-axis feedback control mechanism 7 is turned "ON" to thereby make feedback control of the Z-axial position of the probe 1 so as for the tunnel current to be kept fixed. (step 4)

Next, while the probe 1 is being moved along a straight line or curve along which working is to be performed on the material to be worked 2, measurement is made of the Z-axial position of the probe 1 and the thus-measured data is continuously stored in the memory device 8. (step 5) After having completed the measurement of the configuration of the surface portion of the material to be worked 2 that extends along the working straight line or curve, the probe 1 is returned to the foremost position of the region to be worked.

Next, the Z-axial feedback control mechanism 7 is turned "OFF" and the Z-axial non-feedback control mechanism 9 is turned "ON" so as for the Z-axial position of the probe 1 to be controlled according to the data from the memory device 8. (step 6)

Further, the switching mechanism 12 is operated to make a changeover to the working electrode potential control mechanism 14. An electrochemical cell in a three-electrode system is constructed with the probe 1, material 2 and the reference electrode 10. (step 7)

Next, the probe 1 is moved along the same surface portion configuration as that mentioned previously. (step 8)

During this movement, while controlling the Z-axial position of the probe 1 according to the data from the memory device 8 so that the distance between the probe 1 and the material to be worked 2 may be fixed, an appropriate level of voltage is applied between the probe 1 and the material to be worked 2 by means of the working electrode potential control mechanism 14. (step 9)

Then, according to the level of the voltage applied, and the kind of the electrolytic solution 3 used, at this time, the surface of the material to be worked is etched, or conversely substances are precipitated thereon by electric sedimentation, along the locus that has been traced by the probe 1. (step 10)

By repeating this process, the material to be worked 2 can be finely worked into a predetermined configuration. At this time, by adding a certain offset to the data on the stored Z-axial position of the probe 1, it is possible to freely set the distance between the probe 1 and the material to be worked to be at a magnitude of distance that falls outside a range that enables the detection of the tunnel current and thereby select the size of the working spot and the depth of the working. Also, it is possible to use, as the method of applying a voltage when performing working, a method of applying a constant voltage continuously (constant voltage mode), a method of applying a voltage pulse continuously (constant-voltage pulse mode), a method of applying a constant current while controlling the current that flows so that this current may be kept constant (constant current mode), a method of applying a constant-current pulse while performing control so that this constant-current pulse may be applied (constant-current pulse mode), etc.

Figure 3:
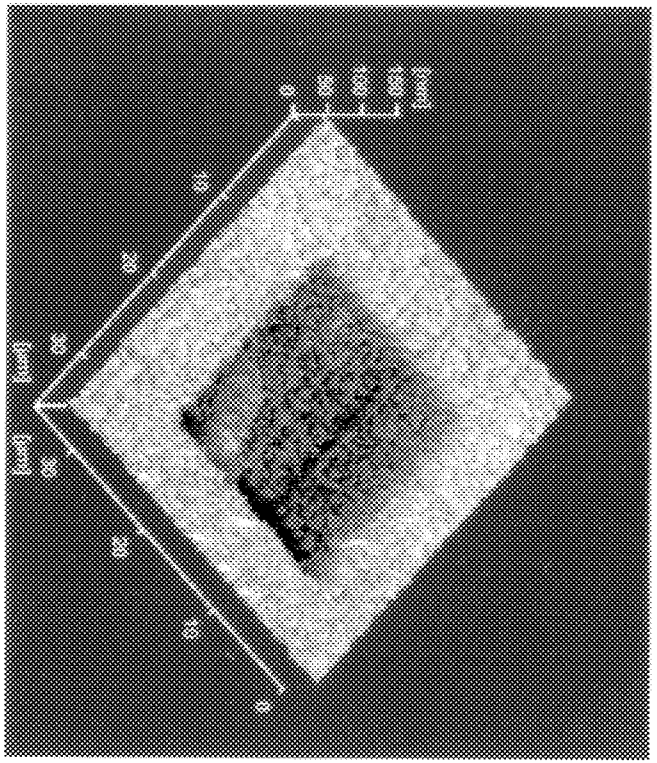
FIG. 3 is a photograph showing an example wherein a pattern is formed on a thin film of chromium by the use of the method of performing fine working according to the present invention.

FIG. 3 is a photograph that has been taken when having observed by means of the scan type tunnel microscope the result that had been obtained by etching a thin film of chromium on a glass substrate by the use of the above-mentioned method. Chromium is deposited by sputtering on the glass substrate to a thickness of 200 nm and the resulting glass substrate is used as the material to be worked 2. An aqueous sulfamic-acid solution of 0.1 mol/l was used as the electrolytic solution 3, a platinum-iridium alloy wire whose tip end was sharpened by electrolytic etching and whose portion that excluded the tip end was clad by resin was used as the probe 1, a platinum plate was used as the outer electrode 11, and a saturated silver/silver chloride electrode was used as the reference electrode 10. First, while under the conditions wherein the tunnel current=0.3 nA the probe 1 is being moved along a straight line having a length of 20 $\mu$m at a speed of 200 nm/sec., the Z-axial position of the probe 1 is stored and measurement is thereby made of the surface configuration of the chromium thin film that extends along the same straight line. Next, while along this straight line the probe 1 was being moved at a position that had been obtained by adding an offset of 20 nm to the stored data, control was performed so that during this movement of the probe a current pulse of $I_{on}$=30 nA, $T_{on}$=0.3 sec. and $T_{off}$=1.0 sec. was applied continuously between the probe 1 and the material to be worked 2 in the constant-current pulse mode. And, the working that corresponds to this straight line was repeated at 200 nm intervals whereby a square pattern of 20×20 $\mu$m was formed finally. The depth of the region thus etched is approximately 100 nm.

As mentioned above, according to the method of performing fine working of the present invention, it is possible to control the distance between the probe and the specimen to be kept fixed with no Faraday-current effect being had thereon. In addition, it is also possible to set the distance between the probe and the specimen to be at a large distance that disables the detection of the tunnel current, with the result that the degree of freedom for setting such distance is high. Also, since the electrochemical cell is constructed with a three-electrode system, it is also possible to control easily the amount of working by controlling the Faraday current.

What is claimed is:

1. A method of performing fine working in which a probe having a fine tip and a material which is to be worked are immersed in an electrolytic liquid to cause an electrochemical reaction of a working region of the material and the liquid between the working region of the material and the probe, comprising the steps of:

creating a four-electrode system by connecting the probe, the material, a reference electrode and a counter electrode, all of which are immersed in the liquid, to a first potential control mechanism for controlling the electric potential of the material and the probe with respect to the reference electrode to be within a range of electric potentials at which the electrochemical reaction will not occur;

measuring a surface configuration of the working region of the material in the four-electrode system;

storing information representative of the measured surface configuration of the working region of the material;

creating a three-electrode system by connecting the probe, the material and the reference electrode, all of which are immersed in the liquid, to a second potential control mechanism for controlling the value of at least one of the potential of the material and the current flowing between the probe and the material in the liquid to be at a predetermined value at which the electrochemical reaction occurs at the working region of the material between the probe and the material; and moving the probe continuously with respect to the material throughout the working region while controlling the distance between the probe and the material according to the stored information representative of the surface configuration, such that the electrochemical reaction takes place at the working region of the material.

2. A method of performing fine working as claimed in claim 1; wherein the step of measuring a surface configuration of the working region of the material comprises the step of conducting an STM measurement by bringing the probe into close proximity with the material in a first direction to produce a tunnel current, causing the probe to undergo relative scanning movement with respect to the material in at least a second direction throughout the working region while measuring the tunnel current, and controlling the distance between the probe and the material in the first direction so as to maintain the tunnel current constant.

3. A method of performing fine working according to claim 1; wherein the step of measuring a surface configuration of the work region of the material comprises the step of conducting a measurement using a scanning probe microscope.

4. A method of performing fine working in which a material to be worked undergoes an electrochemical reaction in a liquid by the use of a probe having a fine tip, comprising the steps of:

constructing an electrochemical cell in the form of a four-electrode system comprising the probe, the material to be worked, a reference electrode and a counter electrode;

setting the respective electric potentials of the probe and the material to be worked to be at values at which the electrochemical reaction will not occur;

controlling a Z-axial position of the probe so that a constant tunnel current flows between the material to be worked and the probe;

moving the probe along a working line while storing the Z-axial position of the probe continuously to store a configuration of the material to be worked;

re-constructing the electrochemical cell in the form of a three-electrode system comprising the probe, the material to be worked and the reference electrode;

moving the probe again along the working line while controlling the Z-axial position of the probe to be at one of the stored position thereof and a position obtained by adding a predetermined offset to the stored position; and applying a voltage between the probe and the material to be worked effective to work the material to be worked along the working line by causing the electrochemical reaction to occur.

5. A method of performing fine working as claimed in claim 4; wherein the liquid comprises an electrolytic solution, and the electrochemical reaction comprises a dissolving reaction in which at least a portion of the material to be worked is dissolved into the electrolytic solution.

6. A method of performing fine working as claimed in claim 4; wherein the liquid comprises an electrolytic solution, and the electrochemical reaction comprises a deposition reaction in which a substance from within the electrolytic solution is precipitated onto the material to be worked.

7. A method of performing fine working in which a probe having a fine tip and a material to be worked are immersed in a liquid to cause the occurrence of an electrochemical reaction between the material to be worked and the probe, comprising the steps of:

measuring a surface configuration of a working region of the material to be worked by approaching the probe tip and the material until a tunnel current is detected and maintaining the tunnel current constant while causing the probe to undergo relative movement with respect to the working region of the material to be worked;

storing a representation of the surface configuration of the working region of the material; and causing the probe to undergo relative movement with respect to the working region of the material while controlling the distance between the probe and the material to be worked according to the stored representation of the surface configuration and simultaneously causing the working operation through the electrochemical reaction.

8. A method of performing fine working according to claim 7; wherein the step of measuring a surface configuration of the working region of the material comprises the step of performing an STM measurement by bringing the probe into close proximity with the material along a first axis to produce a tunnel current, moving the probe with respect to the material along second and third axes throughout the working region while measuring the tunnel current, and controlling the distance between the probe and the material along the first axis so as to maintain the tunnel current constant.

9. A method of performing fine working according to claim 7; wherein the liquid comprises an electrolytic solution and the electrochemical reaction comprises a dissolving reaction in which at least a portion of the material to be worked is dissolved into the electrolytic solution.

10. A method of performing fine working according to claim 7; wherein the liquid comprises an electrolytic solution and the electrochemical reaction comprises a deposition reaction in which a substance from within the electrolytic solution is precipitated onto the material to be worked.

11. A method of performing fine working by selectively conducting an electrochemical reaction at a working region of a material, comprising the steps of:

creating a four-electrode system by immersing a probe, the material, a reference electrode and a counter electrode in a liquid and connecting the probe, the material, the reference electrode and the counter electrode to a first potential control mechanism for controlling the electric potential of the material and the probe with respect to the reference electrode to be within a range of potentials at which a tunnel current will flow between the probe and the material but at which the electrochemical reaction will not occur;

conducting an STM measurement to measure the surface topography of the working region of the material by bringing the probe into close proximity with the material in a first direction to produce a tunnel current, moving the probe with respect to the material in at least a second direction throughout the working region while measuring the tunnel current, and controlling the distance between the probe and the material in the first direction so as to maintain the tunnel current constant;

storing a representation of the surface topography of the working region of the material by continuously storing the position of the probe with respect to the material while the probe is moved with respect to the material throughout the working region;

creating a three-electrode system by connecting the probe, the material and the reference electrode, all of which are immersed in the liquid, to a second potential control mechanism for controlling the value of at least one of the potential of the material and the current flowing between the probe and the material in the liquid to be at a predetermined value at which the electrochemical reaction occurs at the working region of the material; and causing the electrochemical reaction to occur in the working region by moving the probe with respect to the material in at least the second direction throughout the working region while maintaining constant the distance between the probe and the material in the first direction based on the stored representation of the surface topography of the working region.

12. A method of performing fine working according to claim 11; wherein the material is conductive and the electrochemical reaction comprises a reaction whereby at least a portion of the material in the working region is ionized and dissolved by means of a current flowing between the probe and the material.

13. A method of performing fine working according to claim 11; wherein the material is conductive, the liquid comprises an electrolytic solution containing one of a metal, a semiconductor and an organic material, and the electrochemical reaction comprises a reaction whereby the metal, semiconductor or organic material is deposited on the material in the working region by means of a current flowing between the probe and the material.

14. A method of performing fine working according to claim 11; wherein the probe has a fine tip portion disposed in the liquid so as to oppose the material during measurement of the surface topography and during the electrochemical reaction.

15. A method of performing fine working according to claim 14; wherein the distance between the probe and the material in the first direction during the step of causing the electrochemical reaction to occur is offset by a predetermined value from the distance between the probe and the material in the first direction measured during the step of conducting an STM measurement so that no tunnel current flows during the electrochemical reaction.

16. In a scanning probe microscope having a probe positioned relative to a sample surface and having relative motion between the probe and the sample surface in the X and Y plane and controlled and sensed in the Z direction perpendicular to the surface to produce data responsive to the topography of the surface, a method for performing work at a working region of the sample by effecting an electrochemical reaction at the working region between the probe and the sample, comprising the steps of:

conducting a first scan by the probe of the working region of the sample in the X and Y plane and controlling and sensing in the Z direction perpendicular to the surface to produce data representative of the topography of the surface;

storing the data representative of the topography of the surface; and conducting a second scan by the probe of the sample surface while the probe and the sample surface are immersed in an electrolytic solution and maintaining a potential difference between the probe and the sample sufficient to cause an electrochemical reaction at the sample surface between the probe and the sample surface, the second scan being performed using the stored data to control the probe in the X, Y and Z directions.

17. A method according to claim 16; wherein the first scan produces topographical data by a tunnel current measurement.

18. A method according to claim 16; wherein an offset is added to the stored data to control the distance between the probe and the sample in the Z direction during the second scan.

19. A method according to claim 16; wherein the first scan is conducted when the probe and the sample are immersed in a liquid and a potential difference between the probe and the sample is maintained sufficient to prevent the electrochemical reaction from occurring during the first scan.

20. An apparatus including a scanning probe microscope having a probe positioned relative to a sample surface and having relative motion between the probe and the sample surface in the X and Y plane and controlled and sensed in the Z direction perpendicular to the surface to produce data responsive to the topography of the surface, comprising:

means for providing a first scan by the probe of the sample surface in the X and Y plane and controlling and sensing in the Z direction perpendicular to the surface to produce data representative of the topography of the surface;

means for storing the data representative of the topography of the surface; and means for providing at least a second scan by the probe of the sample surface in response to the stored data to control the probe in the X, Y and Z directions in accordance with the stored data while the probe and the sample surface are immersed in an electrolytic solution and for maintaining a potential difference between the probe and the sample sufficient to cause an electrochemical reaction at the sample surface between the probe and the sample surface.

* * * * *